US008974883B2

(12) United States Patent
Cerda Villablanca et al.

(10) Patent No.: US 8,974,883 B2
(45) Date of Patent: Mar. 10, 2015

(54) THIN PACKAGING FILM HAVING AN INCIPIENT TEAR

(75) Inventors: Enrique Cerda Villablanca, Santiago (CL); Eugenio Hamm Hahn, Santiago (CL); Victor Romero Gramegna, Santiago (CL); Benoit Roman, Paris (FR)

(73) Assignees: Centre National de la Recherche Scientifique (CNRS), Paris (FR); Universidad de Chile, Santiago de Chile (CL); Universidad de Santiago de Chile, Santiago de Chile (CL)

( * ) Notice: Subject to any disclaimer, the term of this patent is extended or adjusted under 35 U.S.C. 154(b) by 186 days.

(21) Appl. No.: 13/513,236

(22) PCT Filed: Dec. 2, 2010

(86) PCT No.: PCT/FR2010/052599

§ 371 (c)(1),
(2), (4) Date: Jun. 1, 2012

(87) PCT Pub. No.: WO2011/067542

PCT Pub. Date: Jun. 9, 2011

(65) Prior Publication Data

US 2012/0237713 A1 Sep. 20, 2012

(30) Foreign Application Priority Data

Dec. 4, 2009 (FR) ..... 09 58660

(51) Int. Cl.
*B65D 75/62* (2006.01)
*B65D 75/58* (2006.01)

(52) U.S. Cl.
CPC ..... *B65D 75/5833* (2013.01)
USPC ..... 428/43

(58) Field of Classification Search
CPC ..... B65D 75/5833
USPC ..... 428/43; 220/270; 383/200; 229/200; 493/923, 930
See application file for complete search history.

(56) References Cited

U.S. PATENT DOCUMENTS 4,779,738 A * 10/1988 Akutsu et al. ..... 229/202
2007/0138248 A1 6/2007 Wallen et al.

FOREIGN PATENT DOCUMENTS

EP 0634343 A2 1/1995
LU 91221 A2 8/2007

OTHER PUBLICATIONS

International Search Report, dated Mar. 21, 2011, from corresponding PCT application No. PCT/FR2010/052599.

* cited by examiner

*Primary Examiner* — Alexander Thomas
(74) *Attorney, Agent, or Firm* — Young & Thompson

(57) ABSTRACT

A thin packaging film 1 includes a reference area 2 having a closed contour and which is surrounded over its entire periphery by a tear-off area, an incipient tear 3 being precut in this film so as to intercept this contour while leading into the latter while forming a gripping portion 4 capable of being pulled away from the plane of this thin film, the reference area being designed so as to trap one end of this incipient tear within the contour while the other end propagates by tearing in a spiral from the tear-off area over at least 180° around this reference area when the gripping portion begins to undergo pulling. This closed contour is preferably circular. The closed contour area can in particular be an opening, or a portion of film surrounded by a reinforcement material loop.

18 Claims, 4 Drawing Sheets

THIN PACKAGING FILM HAVING AN INCIPIENT TEAR

BACKGROUND OF THE INVENTION

1. Field of the Invention

The invention relates to the opening of thin packaging, typically made of plastic material.

2. Description of the Related Art

In a conventional manner, various consumer products (packets of biscuits, cigarettes, CDs, DVDs, etc.) are covered with packaging formed by a thin film (or sheet) which is weak, i.e. capable of being torn. Such packaging allows effective protection of the product during the period of time between the end of the manufacture of this product and its entry into service; this means that, before the product is put into service, this packaging must be removed. When such removal is carried out manually, i.e. without a tool, it is achieved in practice by random tears until it is possible to remove the portions of packaging thus separated.

It is well known that such random tears do not allow reliable and rapid removal of the packaging. In fact, with the fingers it is rare to manage to cause a tear which propagates correctly to the extent that it separates two packaging parts which are easy to remove; on the contrary, it is often necessary to make several tears each of which tends to break off rapidly; the number of successive tears that have to be caused is particularly large when it is necessary to start a tear oneself from an edge of the packaging film.

In order to remedy this situation, it has already been proposed to form an incipient tear in the packaging film, typically in the form of a precut tab. But it became apparent that, when a fragile film is torn by pulling on such a precut tab, the sides of the latter tend to converge towards each other during tearing, which results in the detachment of a simple tapered flap, so that a new incipient tear must be sought, which results in the tearing off of a new flap, and so on.

It has also been proposed to combine with a precut tab a strip of underlying material intended to guide the tear in an appropriate manner; however, unless this strip is secured to the packaging film over its entire length (which proves to be complex in practice and risks weakening the packaging inasmuch as it serves as protection thereof), it is not unusual for this strip to allow guiding only as far as the end of the tear line provided. And, assuming that this strip allows guiding of the tear all along this strip, there may then be difficulties in removing the product from the container formed by the remainder of the packaging, given the friction between this product and the inner wall of this packaging (it may be necessary to produce an additional tear line, with the abovementioned difficulties).

To date there is therefore no packaging film making it possible, without complex preparation of the latter, to ensure easy opening of this film in so as to allow removal in a very small number of pieces.

BRIEF SUMMARY OF THE INVENTION

The invention aims to meet this objective and to this end proposes a thin packaging film comprising a reference area having a closed contour, which is surrounded by a tear-off area over its entire periphery, an incipient tear being precut in this film so as to intercept this contour while leading into the latter while forming a gripping portion capable of being pulled away from the plane of this thin film, said reference area being designed so as to trap one end of this incipient tear within said contour while the other end propagates by tearing in a spiral from the tear-off area over at least 180° around this reference area when the gripping portion begins to undergo pulling.

It appears in fact that, by pulling the gripping portion away from the thin film, in practice perpendicular to the latter, a propagation of the tear in a divergent spiral is caused, starting from the outer end of the incipient tear, whilst, due to its being trapped in the reference area, the inner end of the gripping portion is not likely to converge towards this spiral tear; this function of trapping of the inner end by the reference area is useful only for approximately one half-turn of the spiral as it appears that the inner end (or even edge) of the portion of film in the process of separating from the plane of the packaging film then tends to remain within the start of said spiral (see below). In practice, the spiral thus described by the tear in the film in its fragile part has an exponential form and continues as far as the edges of the face formed by the packaging film (and no longer a line as in the known solutions); however the force to be applied for the propagation of the tear remains substantially constant while being moderate.

Advantageously, the gripping portion is in the form of a tab, which facilitates lifting then taking hold of this gripping portion; as a variant, this gripping portion can be provided with an attached pull cord.

According to a first embodiment of the invention, the closed contour of the reference area is skirted on the inside by a material having lower tear-resistance than that of the tear-off area surrounding this closed contour. Preferably, this reference area is an opening the edge of which constitutes the closed contour; this closed contour is advantageously rounded, or even circular, which allows regular behaviour of the film during tearing.

According to a second embodiment of the invention, the closed contour of the reference area is skirted on the inside by a reinforcement material having higher tear-resistance than that of the tear-off area. According to a first option, the closed contour of the reference area is skirted on the inside by a loop of said reinforcement material which is crossed by the incipient tear; by way of example, the reference area comprises an opening bordered on the outside by said loop; as a variant, the reference area comprises a central area surrounded by said loop, this central area preferably having the same tear-resistance as the tear-off area surrounding the closed contour (i.e. the loop can be a loop attached to the packaging film, thus separating inner and outer areas of the same film). According to another option, the entire reference area is formed by this reinforcement material It may be noted that the incipient tear crosses the contour as far as into the reference area, when the latter is materialized.

This reinforcement material is advantageously chosen as being plastic (therefore tear-resistant).

Advantageously, in order to minimize the risk of an unintended tear appearing at the moment when the tear line propagates after a first spiral turn, the incipient tear has one outer end (intended to propagate outside the contour) which is situated so that the tangent to said incipient tear at this point is substantially perpendicular to a tangent to the closed contour passing through this point.

It is worth noting that the contour does not need to represent a significant fraction of the surface area of packaging film to be removed; thus, the inner surface area of the contour can be less than 10%, or even less than 5% (or even 1%) of the packaging surface area of said film.

By way of examples of dimensions which are in particular effective for the removal of packaging films for products such as Hi-Fi cassette or CD or DVD cases, the incipient tear has a length comprised between 0.5 cm and 3 cm and/or the closed contour has an average transverse dimension comprised between 1 and 3 centimeters.

Preferably, the rounded closed contour has an overall circular form, which guarantees regular behaviour of the film during tearing.

It appears that the geometry and the orientation of the incipient tear, in particular its inclination with respect to the contour, have no great significance with regard to the proper detachment of the film by tearing in a spiral.

BRIEF DESCRIPTION OF THE DRAWINGS

Subjects, characteristics and advantages of the invention will become apparent from the following description, given by way of illustrative, non-limitative example, with reference to the attached drawings in which.

DETAILED DESCRIPTION OF THE PREFERRED EMBODIMENTS

Figure 2:
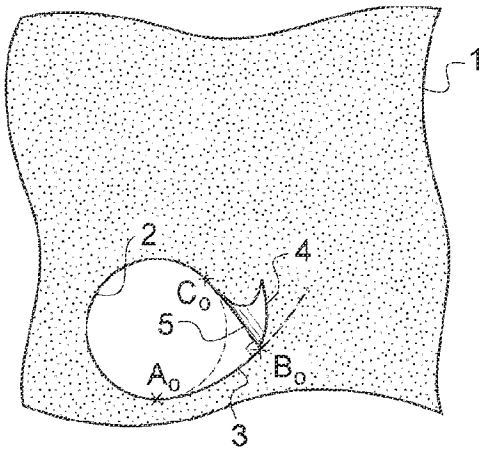
FIG. 2 is a top view of this detail, in an initial tearing phase, prior to that of FIG. 1.
Figure 3:
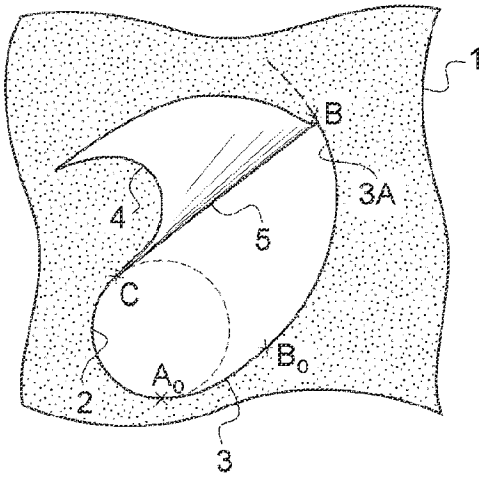
FIG. 3 is a top view thereof in a tearing phase subsequent to that of FIG. 1.
Figure 1:
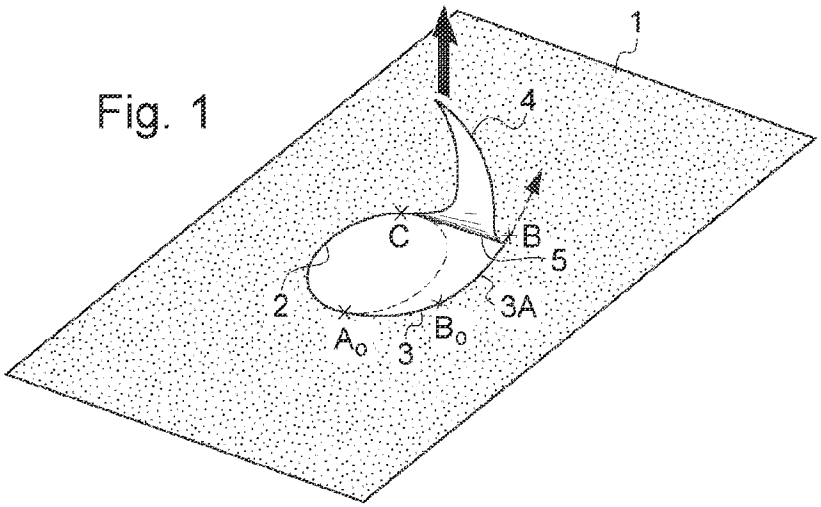
FIG. 1 is a perspective view of a detail of a packaging film according to the invention, in the process of tearing.

FIGS. 1 to 3 together represent a first example of thin packaging film according to the invention, with a first form of incipient tear.

This thin film, a portion of which is represented by the reference 1, comprises an opening 2 the closed contour of which is rounded. In the example shown, this opening has a circular contour, but it can, as a variant (not shown), be oval, or comprise three (or even more) rounded tips. However, as will be easily understood below, it is preferable that this contour is as close to possible to being circular in form, i.e. it has as constant as possible a radius of curvature (except, at the most, at a point denoted $A_0$—see below).

This thin film is of any appropriate known type, both from the point of view of the constituent material and from the point of view of the thickness; by way of example, it is a thin, for example bioriented, polypropylene film (in particular of BOPP type) having a thickness of a few hundredths of a millimeter, optionally metallized.

The thin film 1 comprises, from a point $A_0$ on the contour, an incipient tear 3 constituted by a cut of limited length, denoted $A_0B_0$, starting from the contour in any direction.

The function of this cut 3 is to delimit, together with the contour of the opening 2, a gripping portion 4 capable of being grasped between a user's fingers.

In the example considered, the incipient tear 3 is substantially tangent to the contour of the opening, at $A_0$, so that the gripping portion constitutes a tab, even before starting to pull it transversely to the plane of the film.

This gripping portion is delimited on the one side by the incipient tear 3 (which will be able to propagate) and on the other side by the contour 2 (which will, initially, trap the movement of the inner end of the incipient tear—see below).

FIG. 2 represents the packaging film in a starting configuration in which the tab, initially situated in the plane of the film 1, has been lifted, by a user's fingers, in a direction substantially perpendicular to this plane. This lifting up of the tab spontaneously results in the formation of a fold 5 (i.e. of an area with a very small radius of curvature) substantially starting from the outer end of the incipient tear $A_0B_0$, i.e. from the point $B_0$, as far as the contour 2, being tangent to the latter (the point of tangency in this starting configuration is denoted $C_0$).

This configuration adopted spontaneously by the tab has the advantage that, if the tab is pulled so as to separate it from the plane of the film, a tear 3A is produced in the extension of the initial incipient tear $A_0B_0$ whilst the area 5 with a small radius of curvature (which is here akin to a fold) is displaced in the film, extending from the new end B of the tear line as far as the contour while tending to be tangent to the latter at a point C (B and C denote the current positions of the ends of the fold).

It has been noted that this geometrical relationship tends to be maintained, i.e. as the tear progresses, the fold turns around the opening while remaining tangent to the contour of the latter. Thus FIG. 3 represents a configuration where the fold 5 has turned anti-clockwise around the opening, remaining tangent at C to the contour of the latter, whilst the end B of the tear 3A, i.e. this tear itself, describes a spiral-like curve, so that the tab 4 progressively widens. The larger the dimensions of the opening, the faster the spiral spreads.

It is understood that the closer the direction of pulling is to a direction perpendicular to the plane of the film, the more constant the angle of the fold 5 (i.e. the angle between the plane of the film and the area of the tab situated close to this fold). It is therefore preferable that the direction of pulling is as precisely perpendicular as possible to the plane of the film, but practice has shown that this is not critical (by way of example, a difference of around ten degrees is perfectly acceptable (pulling by an operator's fingers is generally not precisely perpendicular to the plane of the film)).

It has been observed that this phenomenon continues to be apparent even when the fold reaches and passes the point $A_0$, i.e. beyond this point $A_0$, the fold tends to remain tangent to the edge of the opening, now formed by the start of the tear line (the incipient tear $A_0B_0$ then the continuation 3A of the tear).

Continued pulling of the tab in fact results in the propagation of the tear 3 following a spiral curve until an edge of the film is reached. The packaging film can then be removed in a singe piece.

It has been stated above that, when a tab is torn from a film, the lateral tear lines tend to converge. This all takes place here as if the tear 3A (outer edge) tended to move closer to the other edge (inner edge) of the tab, i.e. the contour of the opening 2, then the tear itself, but with a curvature which is less than the curvature of this inner edge, so that, unlike the tabs of the state of the art, this convergent tendency is not sufficient to allow the outer edge 3A to come closer to its inner edge, hence a continuous progression of the tear as far as an edge of the film (or at least as far as the edge of the flat part of the film when the latter is used to wrap a product).

It has been specified that the contour of the opening 2 is rounded, at least outside the point $A_0$. In fact, an angular point of this contour, the tip of which would be directed towards the outside of the opening, would be capable of constituting, due to the stresses applied to the tab, an incipient tear which would cause a second, unintended, tear line to appear, which could converge towards the line 3 until it intercepts the latter. Of course, this comment does not apply to the point $A_0$ since the incipient tear passes through this point, so that, for the start of the propagation of the tear, it does not matter whether or not the opening has an angular point at the point $A_0$; after the tear has made one spiral turn, it also does not matter whether or not the point $A_0$ forms an angular point, since such an angular point does not have its tip directed towards the outside of the opening.

It is understood that it is also advantageous that, in the incipient tear 3, there is no outwardly-directed angular point, since after passing through the point $A_0$, the fold 5 tends to remain tangent to the new edge constituted by the incipient tear 3 then the tear 3A. It is simplest to give the incipient tear a form without any angular point.

In the example shown, the tear line 3A propagates beyond $B_0$ in the extension of the incipient tear 3, so that, when the fold 5 reaches the point $B_0$, after the propagation of the tear over one turn while being tangent to the edge constituted by the incipient tear 3A, it passes therethrough, remaining tangent to the tear 3A which started from $B_0$.

However, it is understood that (see above with regard to the rounded nature of the edge of the opening 2), if the point $B_0$ constitutes an angular point the tip of which is outwardly directed, it can cause the start of an unintended tear line when it is reached by the fold. It is therefore advantageous to avoid this configuration. Since the propagation of the tear from the point $B_0$, at the moment of starting to pull on the tab, tends to take place practically perpendicularly to the fold 5 (therefore perpendicularly to $B_0C_0$), it is understood that it is advantageous that the tangent at $B_0$ to the incipient tear 3 is perpendicular to the line tangent to the opening 2 while passing through $B_0$ (see the right angle shown at $B_0$ in FIG. 2). It is however understood that, if the tear 3A starts from the point $B_0$ by forming an angle greater than 90°, it will follow that this point $B_0$ constitutes an angular point between the incipient tear 3 and the tear line 3A, but since the tip of this angular point is not directed towards the outside of the opening, there will be no risk of a secondary tear when the fold passes through this point B, after one turn of the tear. In other words, it is preferable that the incipient tear 3 is cut so that the angle formed at $B_0$ by the tangent to this incipient tear and the tangent to the opening 2 passing through this point $B_0$ (i.e. $B_0C_0$) is greater than or equal to 90°.

In practice another way of minimizing the risks of an unintended tear when passing through point $B_0$ is to give the incipient tear a curved form, the concavity of which is turned towards the opening; this incipient tear can in particular have the form of the start of a spiral.

It is recalled that the risk of unintended departure from a tear line also depends on the mechanical properties of the material constituting the film, so that it is also possible to minimize the risk of an unintended tear by the choice of a material having limited weakness.

By contrast, after passing through this point $B_0$, there is no further angular point along the contour to which the fold tends to be tangent, since this contour is then the line 3A, of which it was said that it had the form of a spiral.

It has been stated that the angle formed by the incipient tear with the contour 2 is any angle. In fact, if this incipient tear 3 is made to follow a tangent to the contour 2 (if it is rounded, preferably circular), the tab thus formed is narrow, so that it is advantageous that this tab is long enough to minimize the risk that, when the tear starts to propagate from the point $B_0$, this tear converges towards the contour 2 in the case of failure to control the direction in which this tab is pulled. It may therefore appear preferable to adapt the incipient tear so that it forms a non-zero angle with the local tangent to the contour, i.e. it is not tangent to this contour; by contrast, if this angle increases, the width of the tab increases, but it is preferable (see above) to curve this incipient tear so as to turn its concavity towards the inside of the opening.

Figure 5:
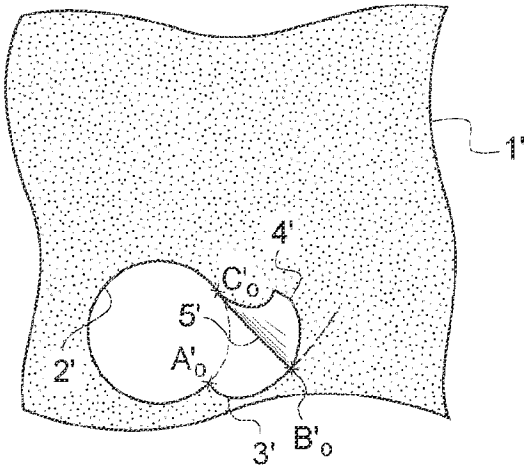
FIG. 5 is a top view thereof in an initial tearing phase, prior to that of FIG. 4.
Figure 6:
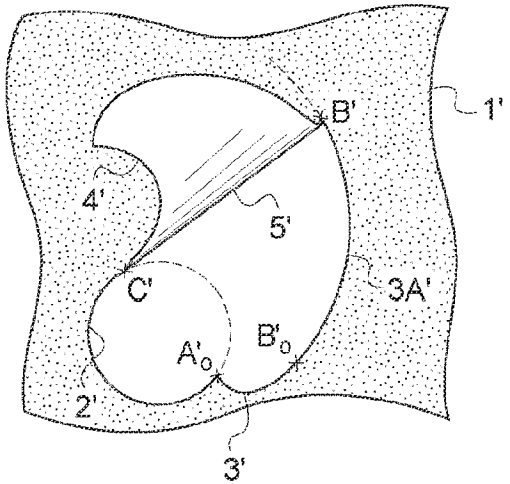
FIG. 6 is a top view thereof in a tearing phase subsequent to that of FIG. 4.
Figure 4:
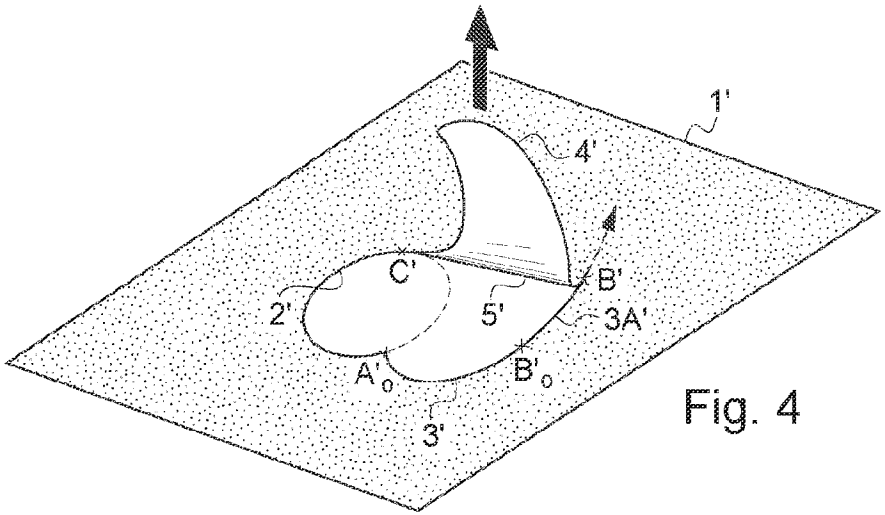
FIG. 4 is a perspective view of a detail of a packaging film identical to that of FIGS. 1 to 3, but comprising another form of incipient tear.

FIGS. 4 to 6 thus represent a variant of FIGS. 1 to 3; the elements similar to those in these figures are denoted by reference signs which are derived from those in FIGS. 1 to 3 by the addition of the "prime" symbol. The film 1' is distinguished therefrom by the fact that the incipient tear 3' extends from the edge of the point $A_0'$, on the contour of the opening 2', following an angle substantially equal to 90°, i.e. the incipient tear 3', close to this point $A_0'$, is substantially perpendicular to the local tangent. However, this incipient tear 3' is curved, with a curvature such that, at the point $B_0'$, its tangent is substantially perpendicular to the direction of the fold 5' (between the points $B_0'$ and $C_0'$) which forms as soon as the tab is pulled perpendicularly to the plane of the film. As stated above, this pulling results in a propagation of the tear, beyond $B_0'$, in the extension of this incipient tear, so that no angular point appears at this point $B_0'$. After one turn of this fold, the latter therefore passes through this point $B_0'$ without difficulty.

The length of this section $A_0B_0$ (or $A_0'B_0'$) is in practice chosen so as to allow easy grasping, by a user's fingers, of the tab delimited by this cut and the contour of the opening; a length of the order of 0.5 cm to 1 cm (or even 1.5 cm or even 3 cm) is a range which seems perfectly appropriate for openings 2 or 2' having an average transverse dimension (this is a diameter if these openings are effectively circular) of a few centimeters (typically comprised between 1 and 3 cm). The dimensions of the spiral then obtained by pulling this tab are large enough to ensure a reasonably rapid removal (in a reasonable number of turns) of the film from the product that it serves to package. Of course, larger dimensions are possible.

It thus appears that providing an opening 2 (or 2') in the film, with a precut incipient tear 3 (or 3') which starts from the contour of this opening, has the effect of imposing a predetermined path on the inner edge (in particular to the inner end) of the tab, as this tab is pulled away from the plane of the film whilst its outer edge tears, this prescribed inner edge being first the contour of the opening, then the contour of the tear 3A (or 3A'), after one turn of the tab around the opening. There is in fact a trapping of the inner edge of the tab, and therefore of its inner end, within the initial opening (during approximately the first half-turn) then of the opening defined by the progression of the spiral.

In fact, the opening 2 (or 2') is capable of locally constituting a deficiency in the protection of the product provided by the packaging film; in fact, dust, in particular, can penetrate as far as the product by crossing the film via this opening. However, this drawback can easily be eliminated by providing, under the film, or above the latter, a localized protection at the area comprising this opening.

When the area precut due to the presence of the incipient tear is small, it is possible to improve the ease of gripping by engaging an additional strip made of any appropriate material forming a pull cord.

Figure 8:
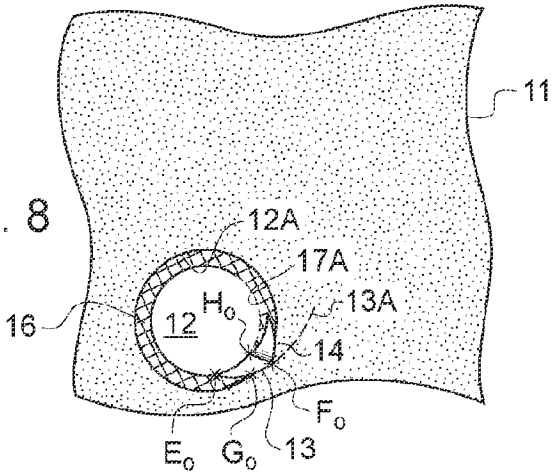
FIG. 8 is a top view of this detail in an initial tearing phase, prior to that of FIG. 7.
Figure 9:
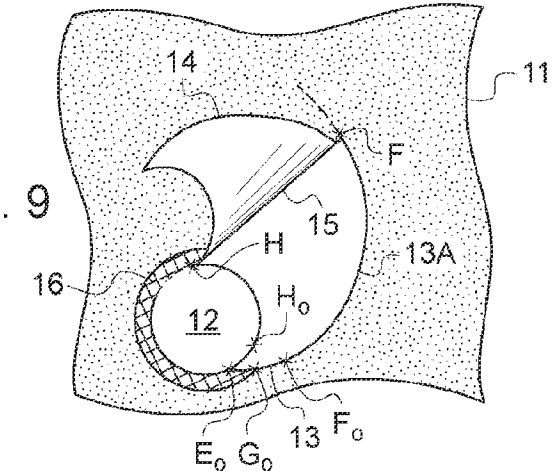
FIG. 9 is a top view thereof in a tearing phase subsequent to that of FIG. 7.
Figure 7:
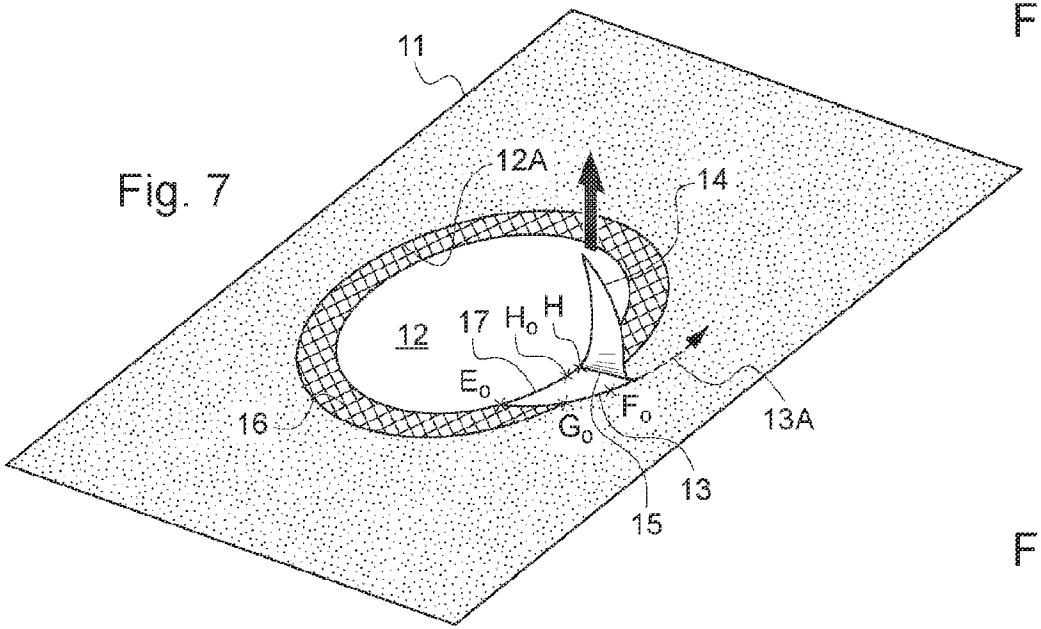
FIG. 7 is a perspective view of a detail of another packaging film according to the invention, in the process of tearing.

FIGS. 7 to 9 represent another embodiment example of a thin packaging film according to the invention, which does not have the drawback of such a potential deficiency in protection.

The elements similar to those in FIGS. 1 to 3 are denoted by reference numbers which are derived from those in FIGS. 1 to 3 by adding the number 10; as regards the letters, they are different.

Thus, these figures represent a thin packaging film 11 comprising a reference area 12 the closed contour of which 12A is rounded and in which a tab 14 is precut. One edge of this tab is an incipient tear 13 constituted by a cut of limited length, denoted $E_0F_0$; this tab, when it is pulled away from the plane of the thin packaging film, forms a fold 15.

The thin film 11 differs from that in FIGS. 1 to 3 by the fact that, instead of stopping along the contour of the opening 2, it extends into the area 12, the latter being bordered by a reinforcement material loop 16, which skirts the inside of the contour 12A. The incipient tear 13 extends from the inner contour of the loop 16 (from the point marked $E_0$), across this loop as far as the point $G_0$ situated on the contour 12A, and outside the latter as far as the point $F_0$.

Moreover, a second incipient tear 17 is advantageously provided along the inner contour of the loop 16 from the point $E_0$, as far as a point denoted $H_0$. The tab 14 can thus be lifted up with respect to the plane of the thin film without the least effort.

However, as a variant, this incipient tear 17 can be omitted, as passing a fingernail (or any other tool) across the precut $E_0F_0$ is sufficient to cause a tear to start along the inner contour of the loop 16.

It is understood that such a film comprises no deficiency in protection at the site of the area 12.

It is moreover understood that, by pulling the tab in a direction suitable to move it away from the plane of the film, there is a tendency to cause a propagation of the tear, denoted 13A, in a manner entirely similar to that which has been explained with regard to the propagation of the tear 3 in the thin film in FIGS. 1 to 3: this tear propagates along a spiral line (the letter F denotes the current position of the outer end of the tear whilst the letter H denotes the current position of the inner end of the inner tear).

In fact, the inner contour of the loop 16 behaves, during the pulling of the tab, like the edge of the opening 2. Thus, whether the tear 17 has been precut or appeared when a fingernail was passed through the incipient tear $E_0F_0$, this tear 17 can only propagate along the inner edge of the loop 16, since it cannot cross this loop (since the latter is made of reinforcement material, it is easier for the tear 17 to propagate in the film, within the loop 16, than to cross this loop). In other words, the inner end of the tab is, at least at the start of the propagation of the tear, trapped within the contour 12A, along the inner contour of the loop 16.

Thus, in FIG. 8, the tab 14 has just been lifted up, before causing the propagation of the ends of the tears 13 and 17 beyond the points $F_0$ and $H_0$, respectively (see the dotted lines 13A and 17A). By contrast, FIG. 9 shows a configuration in which the momentary trace of the fold 15 is substantially tangent to the inner contour of the loop 16, whilst the tear 13A propagates in a spiral curve.

It is understood that, after a fraction of a turn of the fold around the loop (approximately after a half-turn), the propagation of the tear 17A stops (it becomes easier for the film portion 12 to fold with the tab rather than to tear along the inner edge of the loop). As from this moment, the pull exerted on the tab no longer results, as in the example in FIGS. 1 to 3, in propagation of the tear 13A, whilst the fold continues to move along the inner contour until it crosses the loop, passing through the point $E_0$, then the point $G_0$; the inner end of the tab is then no longer trapped within the contour 12A. The continuation of the propagation of the tear then takes place, along the contour defined by the tear 13, as has been described with respect to FIGS. 1 to 3.

Most of the comments expressed with respect to this example in FIGS. 1 to 3 also apply to this second example, including those relating to the geometry of the incipient tear close to its end $F_0$; in particular, this incipient tear is advantageously curved so that the tear which is produced due to the pulling extends the incipient tear.

However, it may be noted that the risks mentioned in the case of a very narrow tab right at the start of the propagation are much lower here, as the risk of the tear 13A crossing the loop from the point F until it meets the tear 17 is minimal given the resistance of the material constituting this loop.

This is why this second example lends itself particularly well to incipient tears inclined at a small angle with respect to the local tangent to the contour (preferably less than 15°).

However, as stated previously, the invention is not limited to any angle value between the incipient tear and the outer contour of the reinforced area.

This loop 16 is for example constituted by an extra thickness constituted by the same material as the thin film. It can also be polyethylene, polypropylene (optionally bioriented), or even metal, in particular.

This loop is advantageously attached to the thin film underneath the latter, so as not to risk becoming caught before the moment when the film is to be removed. It has been found that this arrangement does not impair the strength of the bond between this loop and the thin film, when the tab is pulled.

This loop is advantageously annular in which case its average transverse dimension is a diameter; this average transverse dimension is advantageously of the order of centimeters, for example comprised between 1 cm and 3 cm, as previously. It is understood that, given this petite size, it is much easier to put such a loop in place than to put a strip in place along the entire length of a desired tear line, as in known solutions.

The width of the loop (i.e. the width of the reinforcement strip constituting this loop) is advantageously of the order of a few millimeters, for example comprised between 1 and 5 mm (this can depend on the constituent material; the more resistant the material, the less wide it needs to be).

As previously, the dimensions can be much larger; it is for a person skilled in the art to choose appropriate dimensions as a function of the envisaged use (in particular the dimensions of the packaged product).

Figure 11:
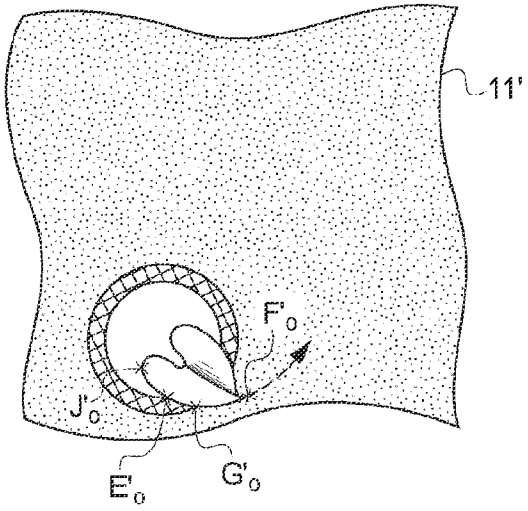
FIG. 11 is a top view thereof in an initial tearing phase, prior to that of FIG. 10.
Figure 12:
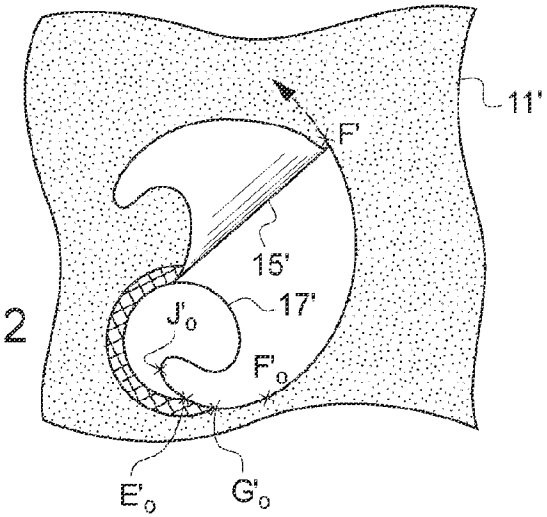
FIG. 12 is a top view thereof in a tearing phase subsequent to that of FIG. 10.
Figure 10:
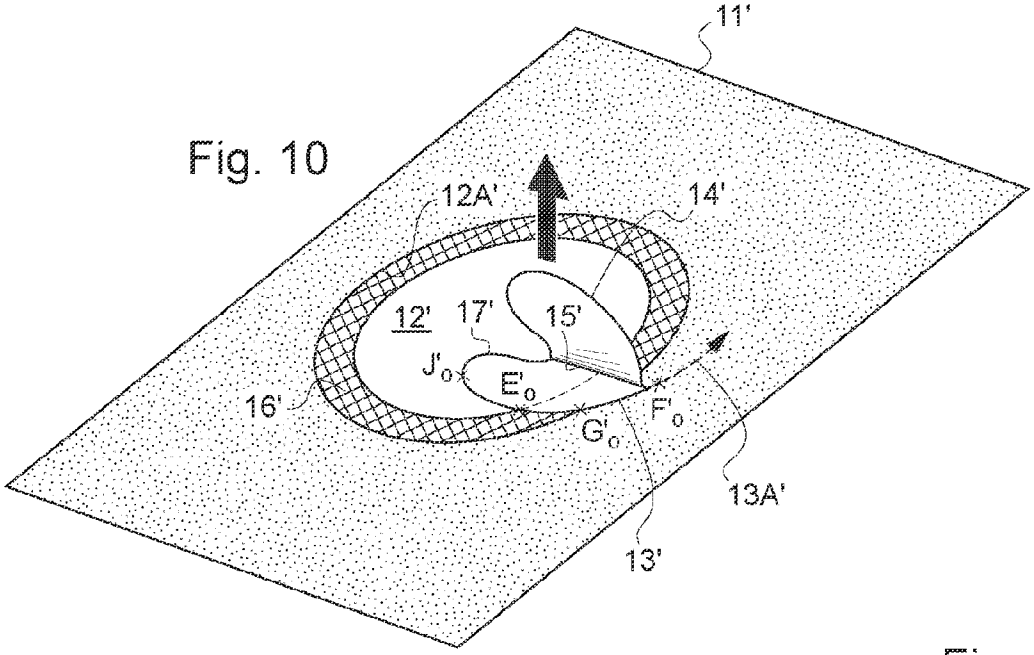
FIG. 10 is a perspective view of a detail of a packaging film identical to that of FIGS. 7 to 9, but having another incipient tear geometry.

FIGS. 10 to 12 represent a variant in FIGS. 7 to 9. The elements similar to those in these figures are denoted by reference signs which are derived from those in FIGS. 7 to 9 by the addition of the "prime" symbol.

The main difference between the film 11' in these FIGS. 10 to 12 with respect to the film 11 in FIGS. 7 to 9 resides in the fact that the incipient tear 13', not only crosses the reinforcement loop 16', but also enters the central area 12, as far as a point denoted $J'_0$. During the pulling of the gripping portion $J'_0F'_0$ thus formed, a tear is produced from the point $F'_0$, as in the example in FIGS. 7 to 9, whilst another tear is produced from the point $J'_0$, opposite the incipient tear itself; this other tear 17' propagates spontaneously in any manner, but as soon as it meets the inner contour of the loop 16', it is forced to follow the inner contour of this loop, as in the example of the abovementioned figures. As previously, there is therefore a trapping of the inner end of the incipient tear 13' within the outer contour 12A' of this loop (this trapping even takes place within the inner contour of this loop).

According to a variant (not shown), the reinforcement material is not limited to a loop within the contour 12A, but extends over the entire area 12; in other words this reinforcement material is in the form of a disc, with a circular contour or not (it can be a solid area of any contour). Providing this reinforcement material is sufficiently tear-resistant, the fact of pulling on the gripping portion defined by the incipient tear causes a propagation of the only end which can propagate, namely the outer end situated outside this reinforcement area whilst the inner end is trapped in this reinforcement area; this trapping effect ceases, as in the case in FIGS. 7 to 12, as soon as this reinforcement area begins to fold, in which case the tear continues, whilst the fold of the tab turns, remaining tangent to the tear 13A, continuing the spiral which has started to form.

Thus it is found that there are several configurations according to the invention; in a first example, the thin film has a greater resistance than the empty space situated within the contour 2 (the edge of the opening constituted by this empty space confines the propagation of the inner end of the incipient tear), whilst, in a second example, the contour is skirted on the inside by a reinforcement material which also confines the inner end of the incipient tear. It is understood that other configurations are possible; thus, according to yet another example, when the contour is bordered on the inside by a reinforcement material which is in the form of a loop, the residual part, within this loop can be an opening without material, be formed by a film with properties different from those of the film outside the contour or, by contrast, be formed by the same tear-off film as on the outside.

The invention claimed is:

1. Thin packaging film (1, 1', 11, 11') comprising a reference area (2, 2', 12, 12') having a closed contour and being surrounded over its entire periphery by a tear-off area, an incipient tear (3, 3', 13, 13') being precut in this film so as to intercept this contour, leading into the latter while forming a gripping portion (4, 4', 14, 14') capable of being pulled away from the plane of this thin film, said reference area being designed so as to trap one end of this incipient tear within said contour while the other end propagates (3A, 3A', 13A, 13A') by tearing in a spiral from the tear-off area over at least 180° around this reference area when the gripping portion begins to undergo such pulling.

2. Thin film according to claim 1, characterized in that the gripping portion is in the form of a tab.

3. Thin film according to claim 2, characterized in that the closed contour of the reference area is skirted on the inside by a material having a tear-resistance substantially lower than that of the tear-off area surrounding this closed contour.

4. Thin film according to claim 3, characterized in that said reference area is an opening (2, 2') the edge of which constitutes the closed contour.

5. Thin film according to claim 2, characterized in that the closed contour of the reference area is skirted on the inside by a reinforcement material (16, 16') having a tear-resistance substantially higher than that of the tear-off area.

6. Thin film according to claim 5, characterized in that the closed contour of the reference area is skirted on the inside by a loop of said reinforcement material which is crossed by the incipient tear.

7. Thin film according to claim 1, characterized in that the closed contour of the reference area is skirted on the inside by a material having a tear-resistance substantially lower than that of the tear-off area surrounding this closed contour.

8. Thin film according to claim 7, characterized in that said reference area is an opening (2, 2') the edge of which constitutes the closed contour.

9. Thin film according to claim 1, characterized in that the closed contour of the reference area is skirted on the inside by a reinforcement material (16, 16') having a tear-resistance substantially higher than that of the tear-off area.

10. Thin film according to claim 9, characterized in that the closed contour of the reference area is skirted on the inside by a loop of said reinforcement material which is crossed by the incipient tear.

11. Thin film according to claim 10, characterized in that the reference area comprises an opening bordered on the outside by said loop.

12. Thin film according to claim 10, characterized in that the reference area comprises a central area (12, 12') surrounded by said loop, this central area having the same tear-resistance as the tear-off area surrounding the closed contour.

13. Thin film according to claim 1, characterized in that the incipient tear has one end (B, B', F, F'), intended to propagate outside the contour, which is situated so that the tangent to said incipient tear (3, 3', 13, 13') at this point is substantially perpendicular to a tangent to the closed contour passing through this point.

14. Thin film according to claim 1, characterized in that the inner surface area of the closed contour is less than 5% of the packaging surface area of said film.

15. Thin film according to claim 1, wherein the film is a polypropylene film.

16. Thin film according to claim 15, wherein the film a thickness of a few hundredths of a millimeter.

17. Thin film according to claim 1, wherein the film a thickness of a few hundredths of a millimeter.

18. Thin film according to claim 1, wherein the film is a capable of being torn when being manually removed without a tool by creating random tears to remove portions of the film thus separated.

* * * * *